United States Patent [19]

Yabu et al.

[11] Patent Number: 4,801,943

[45] Date of Patent: Jan. 31, 1989

[54] PLANE ANTENNA ASSEMBLY

[75] Inventors: Yasuo Yabu; Kazuhisa Akiyama; Toshio Abiko; Minoru Kanda; Mikio Komatsu; Hirohumi Ishizaki; Hidetsugu Nunoya; Yasumasa Ogawa; Hiroshi Yokota, all of Kadoma, Japan

[73] Assignee: Matsushita Electric Works, Ltd., Osaka, Japan

[21] Appl. No.: 3,825

[22] Filed: Jan. 16, 1987

[30] Foreign Application Priority Data

Jan. 27, 1986 [JP] Japan ..... 61-15013
Apr. 24, 1986 [JP] Japan ..... 61-95210

[51] Int. Cl.[4] ..... H01Q 1/38
[52] U.S. Cl. ..... 343/700 MS; 343/778; 343/823
[58] Field of Search ..... 343/700 MS, 786, 840, 343/723, 757, 778, 823

[56] References Cited

U.S. PATENT DOCUMENTS 4,398,199 8/1983 Makimoto ..... 343/700 MS
4,475,107 10/1984 Makimoto et al. .
4,475,108 10/1984 Moser ..... 343/700 MS
4,479,129 10/1984 Skahill ..... 343/840

FOREIGN PATENT DOCUMENTS 0055324 7/1982 European Pat. Off. ..... 343/700 MS
2165700 4/1986 United Kingdom ..... 343/700 MS

*Primary Examiner*—William L. Sikes
*Assistant Examiner*—Doris J. Johnson
*Attorney, Agent, or Firm*—Burns, Doane, Swecker & Mathis

[57] ABSTRACT

A plane antenna assembly comprises a plurality of antenna bases and a signal composing means including amplifiers each connected to output part of each antenna base for composing respective outputs of the antenna bases amplified through the amplifiers, whereby a composite antenna output is obtained in correspondence to the number of the antenna bases and in an excellent S/N ratio.

4 Claims, 5 Drawing Sheets

92b
92c
95a
91
92
92a
95

111
112
116
117

118
111
111a
111b
111c
116
116a
116b
116c
117
117a
117b
117c 118
h
119
111
116
117

131
140
132
AMP
+Vc
S1
R1
D1
R2
C1
C2
C3
D2
R3
S2
R4
C4
-Vc
141
TRANSMISSION CIRCUIT

41°
49°
26°
x
y
171
171a
178
178'
188
189
190
191
198
198'
208
209
151
151a
156
156a
157
158
158a
159
159a
160
160a
161
161a
162
163
164
165
166
167
176
177
179
179a
178a
178'a
180
180a
181
181a
186
187
192
192a
193
193a

PLANE ANTENNA ASSEMBLY

TECHNICAL BACKGROUND OF THE INVENTION

This invention relates to a plane antenna assembly which can remarkably increase its output.

The plane antenna of the type referred to is effectively utilizable in receiving waves and the like which are transmitted as carried on SHF band, in particular, 12 GHz band from a geostationary broadcasting satellite launched into cosmic space to be 36,000 Km high from the earth.

DISCLOSURE OF PRIOR ART

Antennas generally used for receiving circularly polarized waves from a geostationary broadcasting satellite are parabolic antennas erected on the roof or the like position of buildings. However, the parabolic antenna is susceptible to strong wind to easily fall due to its bulky structure so that an additional means for stably supporting the antenna will be necessary, and the supporting means further requires such troublesome work as a fixing to the antenna of reinforcing pole members forming a major part of the supporting means, which work may happen to result even in a higher cost than that of the antenna itself.

In attempt to eliminate these problems of the parabolic antenna, there has been suggested in Japanese Patent Appln. Laid-Open Publication No. 99803/1982 (corresponding to U.S. Pat. No. 4,475,107 or to German Offenlegungsschrift No. 3149200) is a plane antenna which is flattened in the entire configuration. This plane antenna comprises a plurality of cranked microstrip lines arranged in pairs on the upper surface of an antenna body of an insulating substrate of a Teflon glass fiber, polyethylene or the like an earthing conductor provided over the entire lower surface of the antenna body. The pairs of the microstrip lines are connected respectively at one end with each of branched strip line conductors of a power supply circuit provided on the antenna body in a tournament connection so that a travelling wave current can be supplied parallel to the respective paired microstrip lines at the same amplitude and phase. In such plane antenna, the travelling wave current is utilized to achieve a favourable antenna gain, and thus it is necessary to restrain any reflection of signal energy at the other terminating ends of the respective pairs of microstrip lines. For this purpose, the paired microstrip lines have been provided at the terminating ends respectively with such termination resistor as a chip resistor, so that any residual signal energy at the terminating ends of the respective paired microstrip lines can be absorbed by the resistors and any undesirable radiation phenomenon due to reflected signal energy can be prevented from occurring.

The foregoing plane antenna has simplified antenna structure to reduce its cost and the expense of repair work because the antenna can be mounted directly on an outdoor wall of buildings without requiring any additional supporting means. However, this plane antenna has been still defective in that, though the reflection of the signal evergy may be prevented, the signal energy is to be consumed at the resistors as Joule heat, which results in a large power loss and in a reduction in the antenna gain.

For resolving this problem, there has eeen proposed in U.S. patent application Ser. No. 819,610 (or German Patent Application No. 3601649.1) the arrangement of pairs of microstrip lines are provided at the terminating ends respectively with impedance-matched patch antenna means so that all the signal energy having reached the patch antenna means is radiated from the patch antenna means or, in other words, such signal evergy reached the patch antenna means is effectively utilized as radiation evergy. In this case, the power loss can be eliminated to some extent as compared with using the termination resistor.

To obtain a higher gain with the above arrangement, however, it becomes necessary to employ a plurality of the plane antennas having the patch antenna means, but this results in a larger power loss occurring at required power supply system, and it has been impossible to increase the antenna output to a level that the employed number of such plane antennas could naturally afford.

TECHNICAL FIELD OF THE INVENTION

A primary object of the present invention is, therefore, to provide a plane antenna assembly which comprises a plurality of plane antenna bases and still ensures that a composite antenna output corresponding to the number of the antenna bases is obtained at a high gain and S/N ratio.

According to the present invention, the above object is attained by providing a plane antenna assembly which comprises a plurality of antenna bases and means connected to output ports of the respective antenna bases for combining outputs of the antenna bases into a composite antenna output. The output combining means includes a plurality of amplifiers each connected to the output port of the respective antenna bases for amplifying the output thereof, and means connected to the amplifiers for combining signals of the amplified antenna outputs into a composite antenna output signal.

Other objects and advantages of the present invention shall be made clear in the following description of the invention detailed with reference to preferred embodiments shown in accompanying drawings.

Figure 1:
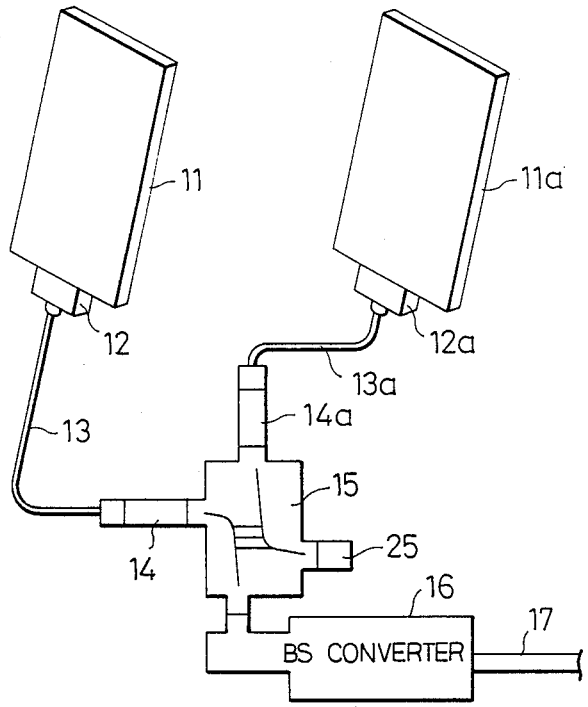
FIG. 1 shows schematically an arrangement in an embodiment of a plane antenna assembly according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Referring to FIG. 1, a plane antenna assembly of the invention includes a plurality of plane antenna bases 11 and 11*a* (only two of which are illustrated in the drawing) which are each provided with a plurality of pairs of, for example, cranked microstrip lines connected respectively at one end with each of branched microstrip line conductors of a power supply circuit in a tournament connection so that a travelling wave current can be supplied in parallel to the respective pairs of the cranked microstrip lines at the same amplitude and phase. In this case, the paired microstrip lines of the plane antenna bases 11 and 11*a* may be provided in any other form than the cranked one. The antenna bases 11 and 11*a* are connected at their output ends with amplifiers 12 and 12*a* which form part of an output combining or composing means and which amplify antenna outputs. The amplifiers 12 and 12*a* comprise preferably a low-noise amplifiers.

Figure 2:
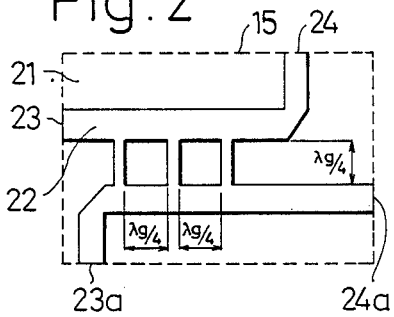
FIG. 2 is a diagram of a signal compositer in the assembly of FIG. 1.

Connected to the amplifiers 12 and 12*a* is a signal combiner means which forms a major part of the output combiner means. The signal composing means includes semi-ragid cables 13 and 13*a*, phase shifters 14 and 14*a*, and a combiner 15 comprising such a directional coupler made up of such microstrip lines as shown in FIG. 2. In the present case, a possible deviation in phase of received electromagnetic waves due to inherent difference in the wave-line propagation length is to be eliminated with means for adjusting the lengths of the cables 13 and 13*a*, and this adjusting means is to form an electrical length correcting means. Any phase deviation still not corrected by the length adjusting means can be corrected by the phase shifters 14 and 14*a*. The semi-rigid cables may be replaced by other power supply lines of which electrical power loss can be compensated for by the amplifiers 12 and 12*a*. Further, the combiner 15 should preferably be provided with an isolator.

Figure 3:
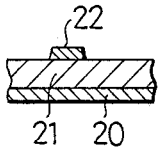
FIG. 3 is a fragmentary cross-sectional view of the signal compositer of FIG. 2.

The combiner 15 comprising the directional coupler should preferably be a so-called 3-dB coupler in which, as shown in FIGS. 2 and 3, a dielectric substrate 21 is provided on its rear side with an earthing conductor 20 and at its front side with a predetermined pattern of microstrip lines 22, the pattern of which has a basic length of ½ of λg including an equivalent wavelength contracting rate and is formed to have input terminals 23 and 23*a* for receiving amplified antenna output signals Sa and Sb, respectively, and output terminals 24 and 24*a* for outputting in-phase components and anti-phase components of the both signals, respectively, while a termination resistor 25 is usually connected to the output terminal 24. As the compositer, a Wilkinson type compositer may similarly be used, with which arrangement, too, the isolation effect can be attained between the both input terminals.

Next, the operation of the plane antenna assembly of FIGS. 1 to 3 will be explained. Now, the antenna outputs of the antenna bases 11 and 11*a* are amplified by the amplifiers 12 and 12*a* and then sent to the compositer 15 through the cables 13 and 13*a* and the phase shifters 14 and 14*a*, respectively. When the S/N ratio of the signals provided to the compositer 15 is assumed to be Sa/Na and Sb/Nb, a composite antenna output of the compositer 15 has an S/N ratio $$Sa/Na+Sb/Nb=2S/N$$

which is improved by 3 dB. Since Sa=Sb=S, Na=Nb=N and Sa and Sb are of the same signal source, their composite signal output will simply be 2S but, as Na and Nb have no correlationship to each other, they will be the same N even when composed together. Therefore, it will be appreciated that, since the outputs of the antenna bases 11 and 11*a* are amplified by the low-noise amplifiers 12 and 12*a* and then provided to the output composing means, a sufficient gain security at the amplifiers 12 and 12*a* assures a sufficient compensation for the power loss in the power supply system, so that a large composite antenna output which is also improved in the S/N ratio can be obtained.

Figure 4:
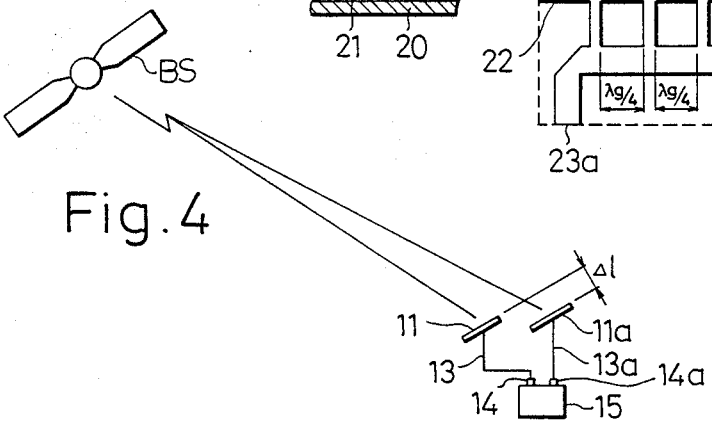
FIG. 4 is a diagram of the signal receiving operation of the assembly of FI.. 5.

Referring here to FIG. 4, the electromagnetic waves sent from a broadcasting satellite BS will reach the respective antenna bases 11 and 11*a* through slightly different propagation lengths and the outputs of the antenna bases 11 and 11*a* will involve a deviation in their phase by an amount corresponding to a difference Δl between the spatial distances from the antenna bases to the satellite. This phase deviation is corrected to be zero by the cable-length adjusting means or electrical-length correcting means and the phase shifters 14 and 14*a*. This correction in effect is carried out on the basis of following equations, with an assumption that the antenna output signals Sa and Sb as amplified by the amplifiers 12 and 12*a* and provided to the compositer 15 are the simplest signals:

$$Sa=\sin(\omega t-\phi a) \text{ or } \sin(\omega t+\phi a)$$

$$Sb=\sin(\omega t-\phi b) \text{ or } \sin(\omega t+\phi b)$$

If $\phi a=\phi b$, then $$Sa+Sb=2\sin(\omega t+\phi)$$

whereas, if the phase is reversed to be $\phi a=\phi b-\pi$, then $$Sa+Sb+0.$$

Therefore, the signal level of the composite antenna output can be made maximum, with the S/N ratio also improved, by so adjusting the cable-length adjusting means and phase shifters 14 and 14*a* as to compose together the in-phase antenna output signals of a zero phase deviation.

Thus produced output of the compositer 15 is sent to an external circuit through a BS converter 16 and a cable 17.

Figure 5:
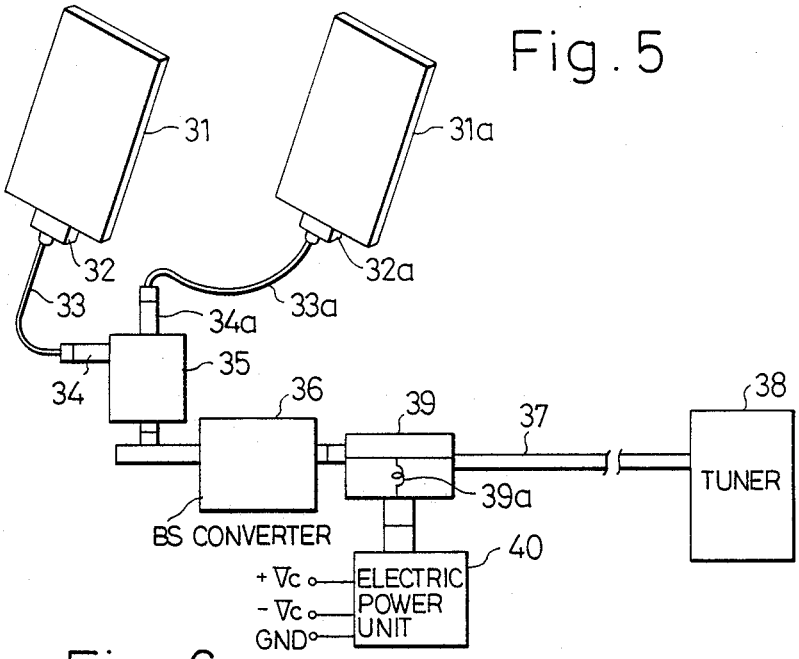
FIG. 5 shows schematically an arrangement in another embodiment of the plane antenna assembly according to the present invention.

Referring to FIG. 5, there is shown another ambodiment of the present invention in which the same constituent elements as those in the foregoing embodiment of FIG. 1 are denoted by the same reference numerals but added by 20. The present embodiment is arranged so that the composite antenna output of a compositer 35 is sent to a BS tuner 38 forming an external circuit through a BS converter 36 and a signal cable 37, and is featured in that the power supply is carried out from the tuner 38 through the cable 37 to antenna bases 31 and 31*a*. On the cable 37, generally, a direct current of 15 V is superimposed as fed from the side of the BS tuner 38 as a voltage fed to the BS converter 36. In this case, a separation unit 39 having a coil 39*a* for eliminating high frequency signals is attached to the signal cable 37, and a power unit 40 which generates at its output terminals +Vc, −Vc and GND positive and negative voltages to be supplied as stabilized, if required, to amplifiers 32 and 32*a* is connected to the separation unit 39.

Figure 6:
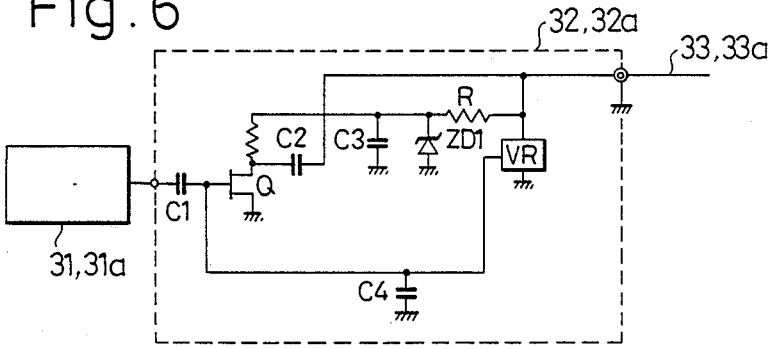
FIG. 6 to 8 are circuit diagrams showing different amplifiers respectively used in the assembly of FIG. 5.
Figure 7:
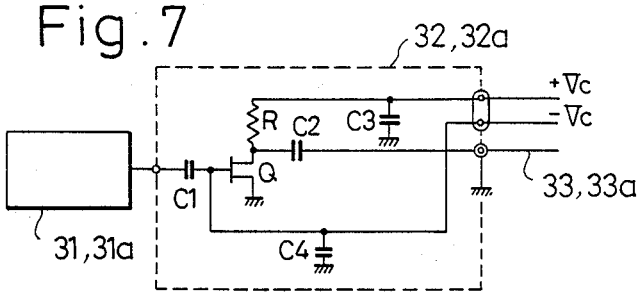
Figure 8:
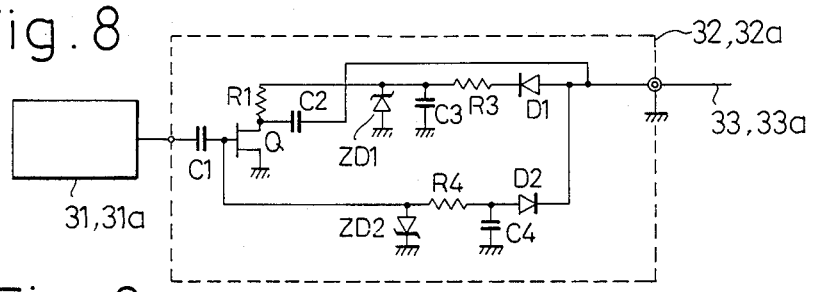

A source voltage can be processed on the side of the amplifiers 32 and 32*a*. That is, the amplifiers 32 and 32*a* are so arranged that, in an aspect shown in FIG. 6, a DC voltage is superimposed on the amplified signals of the waves received at the antenna bases 31 and 31*a* and provided to the semi-rigid cables 33 and 33*a*, a positive voltage stabilized by a Zener diode ZDl is applied between the source and drain of an amplifying element Q of a GaAs-FET and a load voltage generated by a constant voltage circuit VR is applied to the gate of the amplifying element Q to amplify the antenna base outputs. In another aspect of the amplifiers 32 and 32*a* as shown in FIG. 7, the positive and negative voltages +Vc and −Vc from the power unit 40 are applied to the amplifying element Q so as to amplify the antenna base outputs. In still another aspect of FIG. 8, an AC voltage (a sinusoidal or a square wave voltage of a commercial source power) is superimposed on the semi-rigid cables 33 and 33*a*, in which event the AC voltage is rectified by diodes D1 and D2 connected to be opposite in the polarity to obtain the positive and negative voltages.

Other arrangement and operation of the embodiment of FIG. 5 are substantially the same as those in FIGS. 1 to 4.

Figure 9:
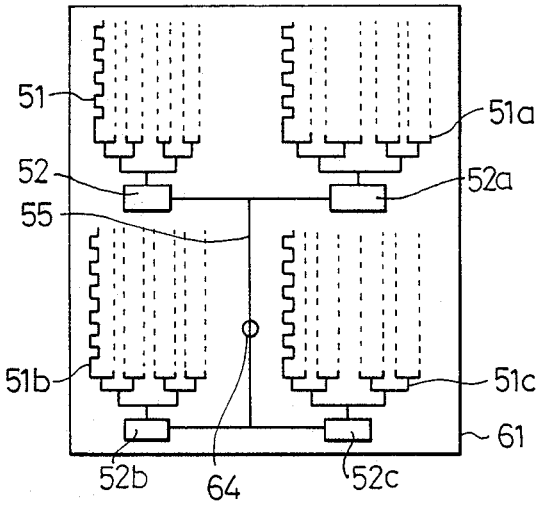
FIG. 9 shows schematically an arrangement in still another embodiment of the assembly according to the present invention.
Figure 10:
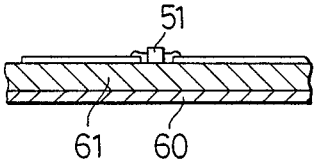
FIG. 10 is a fragmentary cross-sectional view of the assembly of FIG. 9.

In yet another embodiment shown in FIGS. 9 and 10, a plurality of antenna bases 51, 51*a*, 51*b* . . . (only four of which are illustrated in FIG. 9) are arranged on a single substrate. More specifically, a plurality of groups of microstrip lines for the antenna bases 51, 51*a*, 51*b* . . . are provided on a front side of a dielectric substrate 61 carrying on its rear side an earthing conductor 60, to each of which groups of the microstrip lines such amplifiers 52, 52*a*, 52*b* . . . as GaAs-FET's are respectively connected also on the substrate. With such arrangement, the electric power loss at interconnecting parts of the amplifiers 52, 52*a*, 52*b* . . . and at a power supply system can be minimized, a composite antenna output obtainable at an output terminal 64 of a compositer 55 connected to the respective amplifiers can be enlarged with an improved S/N ratio, while mounting cost of the amplifiers 52, 52*a*, 52*b* . . . is also reduced. Other arrangement and operation of this embodiment are substantially the safe as those in FIGS. 1 to 4.

Figure 11:
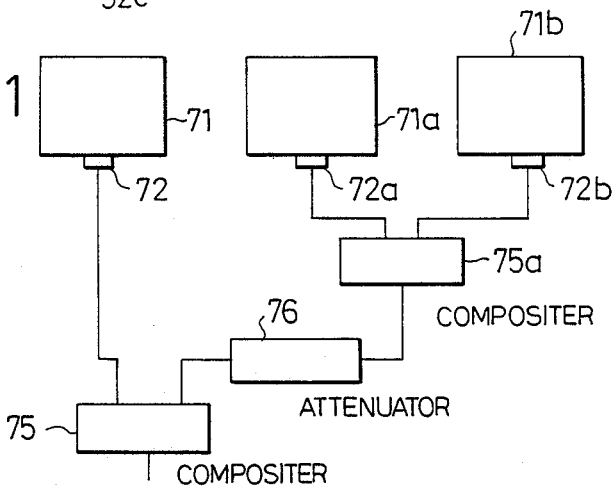
FIGS. 11 and 12 are schematic diagrams each showing the assembly in yet another embodiment of the present invention.

Referring to FIG. 11 of a further embodiment, there are provided three antenna bases 71, 71*a* and 71*b* to output end of respective which each of amplifiers 72, 72*a* and 72*b* is coupled, a compositer 75 is connected to the amplifier 72 of the antenna base 71 and a further compositer 75*a* is connected commonly to the amplifiers 72*a* and 72*b* of the antenna bases 71*a* and 71*b*, while the both compositers 75 and 75*a* are interconnected with a 3-dB attenuator 76 interposed between them for equalizing the levels of input signals to the both compositers. Other arrangement and operation of the present embodiment are substantially the same as those in FIGS. 1 to 4.

Figures 12, 13, 14, 15, 16:
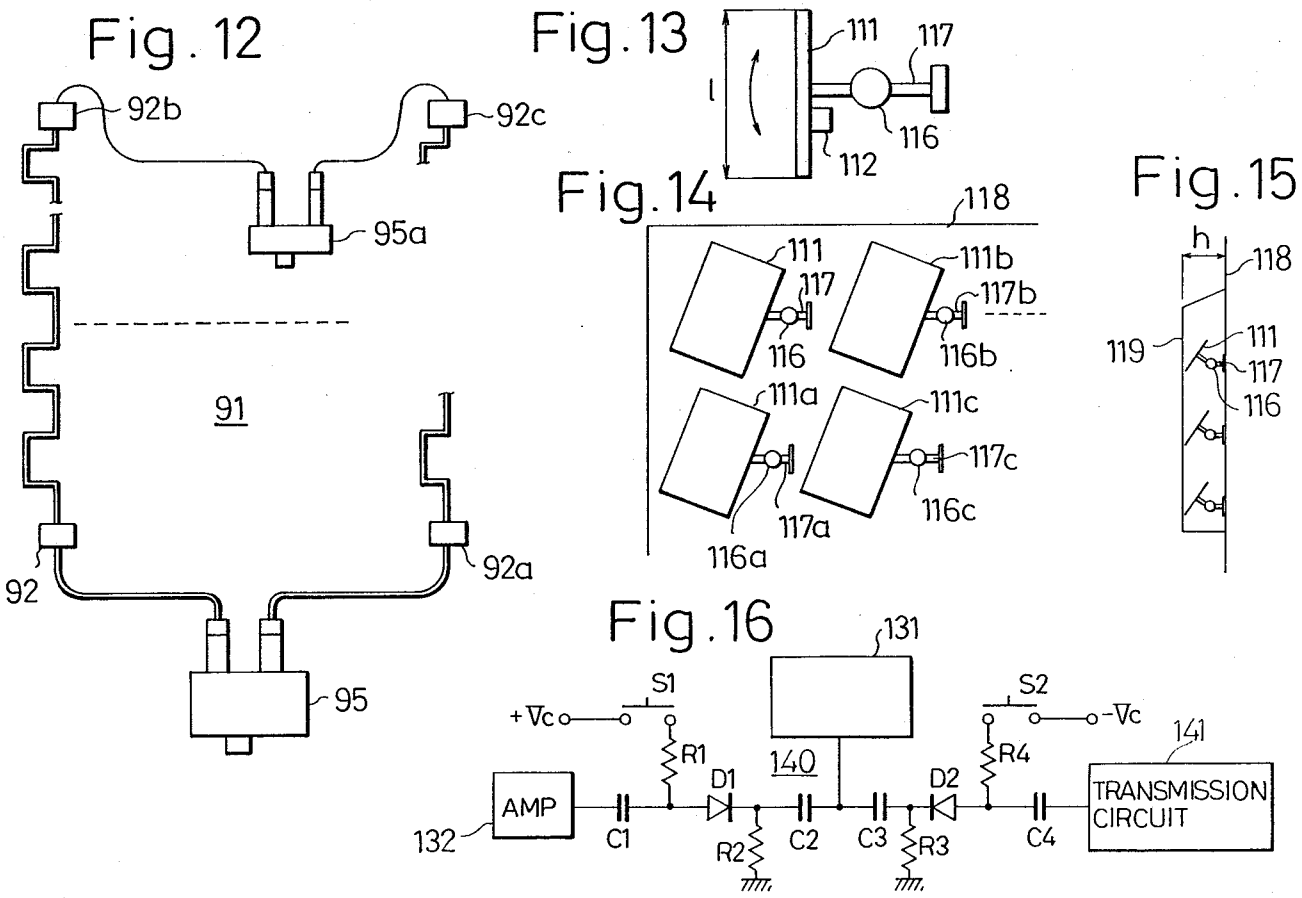
FIG. 13 is a schematic diagram showing an antenna base used in yet another embodiment of the present invention.
FIGS. 14 and 15 show schematically different side views the assembly using the antenna base of FIG. 13.
FIG. 16 is a circuit diagram of still another embodiment of the present invention.

Referring to yet another embodiment shown in FIG. 12, the antenna assembly comprises an antenna base 91 arranged to be capable of receiving both of left-handed and right-handed circularly polarized waves. In this example of the arrangement, amplifiers 92 and 92*a* for right-handed circularly polarized wave as well as amplifers 92*b* and 92*c* for left-handed circularly polarized wave are connected to both ends of the microstrip lines on the antenna base 91, and compositers 95 and 95*a* are arranged to respectively compose together outputs of the amplifiers 92 and 92*a* and outputs of the amplifiers 92*b* and 92*c*. Therefore, two power supply systems are thereby provided, and the assembly is made capable of dealing with both of the left-handed and right-handed circularly polarized waves. Other arrangement and operation of the present embodiment are substantially the same as those in FIGS. 1 to 4.

In a further embodiment shown in FIGS. 13 to 15, a plurality of antenna bases 111, 111*a*, 111*b*, 111*c* . . . corresponding in number to the desired gain are installed in a unit on a base board 118 through rotatable supports 117, 117*a*, 117*b*, 117*c* . . . respectively including each of angle adjusting means 116, 116*a*, 116*b*, 116*c* . . . for adjusting installation angle of the respective antenna bases with respect to the base board 118 by rotating them in direction of an arrow x in a side view of FIG. 13, so that the orientation of the respective antenna bases 111 . . . is made variable to provide to the antenna assembly an optimum wave-receiving directivity. In this embodiment, a cover 119 may be mounted over the antenna bases, if necessary. In this connection, the height h of the cover 119 from the base board 118 must be large enough for allowing the antenna bases to be fully rotated as desired, but the height h may be still kept not unduly large by, for example, reducing the length l of the respective antenna bases in their rotating direction. Other arrangement and operation of the present embodiment are substantially the same as those in FIGS. 1 to 4.

Still another embodiment shown in FIG. 16 is a plane antenna assembly, which comprises a signal switching circuit 140 provided for the purpose of allowing the assembly to be used for both of signal transmission and reception. That is, when a first switching member S1 is turned ON, a signal received at an antenna base 131 is provided through a diode D1 to an amplifier 132, whereas, when a second switching member S2 is turned ON, a transmission signal generated by a transmission circuit 141 is provided through a diode D2 to the antenna base 131 for transmission therethrough, so that the assembly can be selectively used either for transmitting or receiving the signal. Other arrangement and operation of the present embodiment are substantially the same as those of FIGS. 1 to 4.

Figures 17, 18, 19, 20, 21:
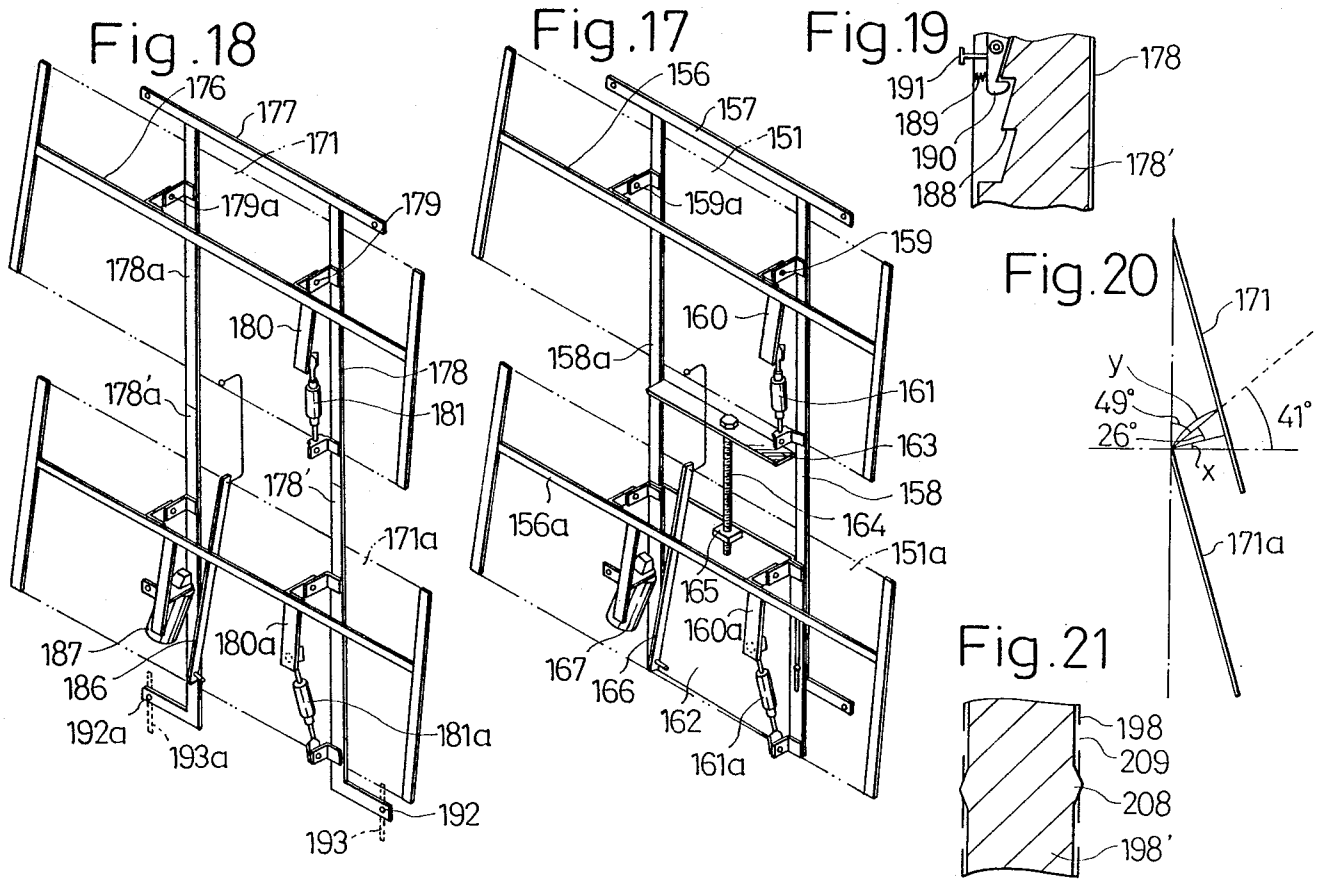
FIG. 17 is a schematic perspective view of an embodiment of a supporting structure for the antenna bases to be used in the assembly of the present invention.
FIG. 18 is a schematic perspective view of another embodiment of the supporting structure.
FIG. 19 is a fragmentary cross-sectional view of the supporting structure of FIG. 18.
FIG. 20 is a diagram for explaining the supporting structure of FIG. 18.
FIG. 21 is a fragmentary cross-sectional view of yet another embodiment of the supporting structure.

According the still another feature of the present invention, means is provided for adjusting relative angle and position of the plurality of antenna bases to one another for easy phase shift adjustment between the respective antenna bases, without requiring any phase shifter, so as to eliminate any inherent loss at the phase shifter and to lower the manufacturing costs. Referring to FIG. 17 of an example of two antenna bases which are shown by chain-lines for brevity, one antenna base 151 is secured to an H-shaped stationary frame 156 which in turn is pivotably mounted through pivot pins 159 and 159*a* to vertically extending parallel beams 158 and 158*a* of a substantially $\pi$-shaped base frame 157. The stationary frame 156 is provided with a depending piece 160 to which one end of a turn buckle 161 is pivotably secured while the other end of this turn buckle 161 is pivotably secured to one beam 158. A slide board 162 is vertically slidably mounted across lower parts of the both beams 158 and 158*a* by means of slidable engagement of pins in vertically extended slots made in the beams. Another antenna base 151*a* is also fixed to an H-shaped stationary frame 156*a* to which a depending piece 160*a* is attached, and another turn buckle 161 is pivotably secured at one end to the beam 158 and at the other end to the depending piece 160*a*. Fixedly provided between the beams 158 and 158*a* is a guide plate 163 in which an adjusting bolt 164 is axially rotatably held to extend vertical. The adjusting bolt 164 is screwed at its lower part into a threaded piece 165 secured to one side of the slide board 162. Attached also onto one side of the parallel beams 158 and 158*a* are a compositer 166 which is connected to power supply ends of the both antenna bases 151 and 151*a* so as to compose together outputs of the bases 151 and 151*a* as well as a converter 167 which converts a frequency of a reception signal of the compositer 166 in a 12 GHz band into 1 GHz.

In the present embodiment, the elevation angle of the antenna bases 151 and 151*a* can be adjusted by properly extending or shortening the turn buckles 161 and 161*a* relative to the antenna bases 151 and 151*a*, while the vertical position of the antenna base 151*a* with respect to the base 151 can be adjusted by properly turning the adjusting bolt 164 bacause the turning causes the slide board 162 and eventually the lower antenna base 151*a* to be moved upward or downward depending on the axial turning direction of the bolt 164. As a result, a phase shift between a plurality of antenna bases can be adjusted as desired. Other arrangement and operation of the present embodiment are substantially the same as those in FIGS. 1 to 4.

In another example shown in FIGS. 18 and 19 of the angle and position adjusting means, substantially the same members as those in the foregoing example of FIG. 17 are denoted by the same reference numerals but added by 20. In the present instance, the parallel beams of a substantially $\pi$-shaped base frame 177 are divided into upper and lower sections 178, 178*a* and 178', 178*a'* respectively for supporting each of two antenna bases 171 and 171*a*, while these upper and lower beam sections are slidably coupled to each other at mutually joining parts. The lower beam section 178' has a cross section of saw tooth steps 188, while the upper beam section 178 is provided with a hook 190 having a finger projection 191 which is resiliently locked to one of the saw tooth steps 188 as biased by a spring 189, so that a relative position of the antenna bases 171 and 171*a* to each other can be suitably adjusted and set by lifting the hook 190 against the spring load, sliding the lower beam sections 178' and 178*a'* and engaging the finger 191 to another one of the steps 188. When the antenna assembly is to be installed in, for example, Osaka district of Japan, the elevation angle of the antenna assembly toward the broadcasting satellite is set to be 41 degrees and the antenna sidelook angle ($90° - \theta$) is set to be 26 degrees as shown in FIG. 20, wherein x represents a distance between the antenna bases 71 and 171*a* and y denotes a phase shift between them. In this case, the allowable range of the phase shift can be set to be $\pm 12$ degrees. Further, it is preferable that the lower beam sections 178' and 178*a'* are provided at their lower ends with pins 192 and 192*a* and, for example, a casing in which the plane antenna assembly is housed is provided with vertical slots 193 and 193*a* for receiving the pins 192 and 192' so as to provide a guiding function to the slide of the lower beam sections 178' and 178*a'*. Other arrangement and operation of the present embodiment are substantially the same as those in the embodiments of FIGS. 1 to 4 and FIG. 17.

In yet another example shown in FIG. 21, the parallel beams of the $\pi$-shaped frame are also divided into two sections as in the case of FIGS. 18 and 19, but, in place of the saw tooth steps and hook arrangement, a lower beam section 198' is provided with resilient projections 208 and an upper beam section 198 is provided with opposing raws of holes 209 for receiving the projections 208, so that relative position of antenna bases to each other can be properly adjusted and set by engaging the projections 208 in suitable ones of the holes 209. Other arrangement and operation of the present embodiment are substantially the same as those in the embodiments of FIGS. 1 to 4, FIG. 17 and FIGS. 18 to 20.

What is claimed as our invention is:

1. A plane antenna assembly comprising:

a plurality of antenna bases, each base having an output port;

signal amplifying means connected to each of the output ports to receive and amplify output signals from the antenna bases;

signal combining means connected to each of the signal amplifying means to receive and combine the amplified output signals;

position-adjusting means connected to the signal amplifying means for adjusting the electrical transmission distance from each of the output ports to the combining means, thereby to selectively minimize phase deviations between the amplified signals that are combined.

2. An assembly according to claim 1 wherein said antenna bases are include microstrip lines formed commonly on a single dielectric substrate, and said amplifying means are provided on said single substrate and are connected to the microstrip lines.

3. A plane antenna assembly for receiving electromagnetic wave transmissions comprising:

a plurality of antenna base means, each base means having an output port;

signal amplifying means connected to each of the output ports to receive and amplify output signals from the antenna base means;

signal combining means connected to each of the signal amplifying means to receive and combine the amplified output signals;

position-adjusting means connected to the signal amplifying means for adjusting the electrical transmission distance from each of the output ports to the signal combining means, each of the position-adjusting means being a semi-rigid cable having an adjustable length and being operable to selectively minimize phase deviation between the combined signals.

4. A plane antenna assembly comprising:

a plurality of antenna base means, each base means having an output port;

signal amplifying means connected to each of the output ports to receive and amplify output signals from the antenna bases;

signal combining means connected to each of the signal amplifying means to receive and combine the amplified output signals;

signal phase shifter means connected to the combining means for selectively minimizing phase deviations between the amplified signals that are combined.

* * * * *